US006694698B2

(12) United States Patent
Ryan

(10) Patent No.: US 6,694,698 B2
(45) Date of Patent: Feb. 24, 2004

(54) REINFORCEMENT APPARATUS FOR MONOPOLE TOWERS

(75) Inventor: Ralph E. Ryan, Mountaintop, PA (US)

(73) Assignee: Creative Design & Maching, Inc., Clarks Summit, PA (US)

( * ) Notice: Subject to any disclaimer, the term of this patent is extended or adjusted under 35 U.S.C. 154(b) by 0 days.

(21) Appl. No.: 10/137,972

(22) Filed: May 3, 2002

(65) Prior Publication Data

US 2003/0205021 A1 Nov. 6, 2003

(51) Int. Cl.[7] ..... E04C 3/00

(52) U.S. Cl. ..... 52/741.1; 52/745.21; 52/736.3; 52/736.4; 52/737.5; 52/738.1; 52/723.1; 52/723.2

(58) Field of Search ..... 52/736.3, 736.4, 52/737.4, 737.5, 738.1, 723.1, 723.2, 741.1, 745.05, 745.21, 745.09, 745.1, 745.11, 745.12

(56) References Cited

U.S. PATENT DOCUMENTS

| | | | | | |
|---|---|---|---|---|---|
| 985,605 | A | * | 2/1911 | Konopinski | 52/723.2 |
| 1,982,569 | A | * | 11/1934 | Byrd | 52/298 |
| 1,995,874 | A | * | 3/1935 | Van De Mark | 52/736.4 |
| 2,707,034 | A | * | 4/1955 | Hetrick | |
| 3,714,750 | A | * | 2/1973 | Pallotto | 52/736.3 |
| 5,974,744 | A | * | 11/1999 | Guilbeault | 52/170 |
| 6,305,140 | B1 | * | 10/2001 | Knight | 52/736.1 |
| 6,453,536 | B1 | * | 9/2002 | Muller et al. | 29/423 |

* cited by examiner

*Primary Examiner*—Jeanette Chapman
(74) *Attorney, Agent, or Firm*—Sanford J. Piltch, Esq.

(57) ABSTRACT

The present invention is directed towards a reinforcement apparatus forming an exo-skeleton of tubular steel rods and adjustable mounting clamps directly in contact with the exterior of previously erected tapered wireless communication monopole towers to provide additional strength and resistance against deflection due to wind forces and additional weight thereby enabling the placement of more antenna arrays and communication instruments thereon.

2 Claims, 4 Drawing Sheets

REINFORCEMENT APPARATUS FOR MONOPOLE TOWERS

FIELD OF THE INVENTION

This invention relates to a reinforcing apparatus applied to the exterior of a monopole supporting a communications antenna array having a plurality of rods connected to adjustable brackets for providing additional strength along the length of the monopole sufficient to overcome the force moment from additional weight and wind shear.

BACKGROUND OF THE INVENTION

In response to the increased number of cellular telephone users, wireless communication providers are expanding wireless services. One of the ways to meet the needs of the cellular telephone users is by constructing new antennae bearing monopole towers, often referred to as cell sites. However, local zoning laws often prohibit the construction of new cell sites except in certain pre-designated areas which may not provide sufficient coverage for the expanding wireless services. To circumvent this problem, wireless communication providers are placing additional antenna systems on existing monopole towers. Since already erected monopole towers were not designed to safely support the additional antenna loads, these towers must be reinforced to not only provide the needed support for the additional antenna load, but also the additional forces the wind and other environmental conditions will exert on the monopole tower due to the increase in the surface area presented by the added antenna array(s).

One method for reinforcing monopoles is by overlaying a new outer steel skin over the existing monopole. This type of procedure is exceptionally expensive and laborious, since the new outer steel skin must be fabricated to fit the existing monopole with small tolerances for dimensional error. The installation of this type of reinforcement is inefficient in that placing the new outer skin over the existing pole requires many field personnel and large cranes to accommodate the weight of the overlay pieces.

Another way monopole towers have been reinforced is by welding bar, angle or tubular steel sections to the exterior surface of the monopole. Although the addition of the steel to the monopole will increase the strength, the process is extremely labor intensive, costly, and greatly reduces the integrity of the galvanized steel in the monopole to resist rust, which will eventually compromise the strength of the monopole.

Already erected monopoles have also been strengthened by constructing metal lattice-work structures around the existing monopole tower. Such lattice structures often require more land, are aesthetically displeasing, and are expensive and time consuming to erect.

Additionally, another known method utilizes hollow steel rods which extend along the length of the monopole and are attached by way of a conformed mounting bracket having an arc length of fixed diameter corresponding to the diameter (or circumference) of the monopole at the point of attachment. In most cases, monopoles are gradually tapered from the base to the top, wherein the diameter at the base of the monopole is larger than the diameter at the top. This taper poses a problem for mounting brackets having a fixed diameter, in that brackets must be custom made, having a specific diameter closely matching the arc length of the erected pole, to provide reinforcement at particular locations along the monopole. In order to attach the rods along the monopole, a variety of mounting brackets having differing diameters must be used. Manufacturing custom made mounting brackets and utilizing numerous differently sized mounting brackets to fit particular locations along the length of the monopoles is not only expensive, but also labor intensive and time consuming.

Thus, there is a need in the field of monopole reinforcement, to provide a cost effective, aesthetically pleasing, durable and simple way to adequately reinforce and strengthen monopole towers.

SUMMARY OF THE INVENTION

The present invention is directed to a reinforcement apparatus forming a total or partial exo-skeletal frame for support directly upon the surface of an existing erected monopole tower to provide additional stability and strength to resist the force moment from wind resistance caused by the increased surface area and weight loading of additional antenna arrays through the use of a series of adjustable mounting clamps and associated perimeter support rods.

More particularly, the present invention is drawn to a cost effective and efficient way to provide stability and resistance to deflection to already erected tapered monopole towers by constructing a simple and inexpensive reinforcement apparatus circumscribing a monopole structure at varying heights from the base and having adjustable mounting clamps and perimeter support rods positioned on and along the surface of the monopole. The mounting clamps have adjustable spacings to easily fit around the monopole at any position along the entire length (height) of the pole. Connecting the adjustable mounting clamps are a series of perimeter support rods, which extend along the length of the monopole tower in close proximity to the outer skin of the pole.

As the preferred embodiment of the present invention, a reinforcement apparatus for a monopole structure comprises a plurality of support rods and at least two adjustable mounting clamps having guide tubes extending along and in close proximity to the outer skin of the pole. The plurality of support rods have first and second ends with each respective end of the support rods receiving one of the plurality of guide tubes. The adjustable mounting clamps comprise a plurality of interconnecting brackets connected to one another by length adjustable attachment members. Although differing adjustable attachment members can be used in the present invention, threaded rods and nuts of sufficient strength are preferred.

The plurality of interconnecting brackets include a steel plate having a flat central portion, first and second ends set at angles with respect to the flat central portion with the guide tube being attached onto the flat central portion. The outside dimension of the plurality of guide tubes are nearly the same or slightly smaller than the inside dimension of the plurality of perimeter support rods so as to provide a snug fit upon insertion of the guide tube into the support rod. Although the guide tubes can be limited to extend in a single direction from the bracket, guide tubes extending in opposing directions along the monopole structure are preferred.

Additional reinforcement can be incorporated into the preferred embodiment of the present invention by the reinforcement apparatus circumscribing the monopole structure and comprising a plurality of support rods having opposing ends and extending along the monopole structure to at least three adjustable mounting clamps at each end of the guide tubes, such that each adjustable mounting clamp has a plurality of guide tubes extending in opposing directions along the monopole structure which are inserted into and attached to the ends of the plurality of support rods. The adjustable mounting clamps comprise a plurality of interconnecting brackets connected to one another by length adjustable attachment members.

Alternatively, the present invention is also directed to a method for reinforcing a tapered monopole tower. This method includes the steps of attaching and loosely securing a first set of at least two adjustable mounting clamps, having guide tubes thereon, to and around the monopole tower at a predetermined height from the base and separated a distance apart from one another, connecting a set of support rods to one of the adjustable mounting clamps by inserting the guide tubes into respective cooperating ends of the set of support rods. The method next includes the steps of attaching and loosely securing a second set of at least two adjustable mounting clamps and inserting the guide tubes of one of the second set of adjustable mounting clamps into the other respective cooperating ends of the set of support rods and tightly securing the plurality of support rods to the adjustable mounting clamps by inserting affixing members therein. The method next includes the tightening of both first and second sets of adjustable mounting clamps to retain the support rods in close proximity over the desired outer skin area of the monopole tower.

Additional reinforcement can be supplemented to the described method of the present invention by attaching additional sets of adjustable mounting clamps at different heights to the monopole tower. The supplemental method includes the steps of inserting the guide tubes on the additional adjustable mounting clamp sets into the respective cooperating ends of the additional sets of support rods and tightly securing the plurality of support rods to the adjustable mounting clamps by inserting affixing members therein. The supplemental method next includes the tightening of the sets of adjustable mounting clamps to retain the support rods in close proximity over the desired outer skin area of the monopole tower.

BRIEF DESCRIPTION OF THE DRAWINGS

For the purposes of illustrating the invention, there is shown in the drawings, forms which are presently preferred; it being understood, however, that the invention is not limited to the precise arrangements and instrumentalities shown.

DETAILED DESCRIPTION OF THE PREFERRED EMBODIMENT

The following detailed description is of the best presently contemplated modes of carrying out the invention. The description is not intended in a limiting sense, and is made solely for the purpose of illustrating the general principles of the invention. The various features and advantages of the present invention may be more readily understood with reference to the following detailed description taken in conjunction with the accompanying drawings.

Figure 1:
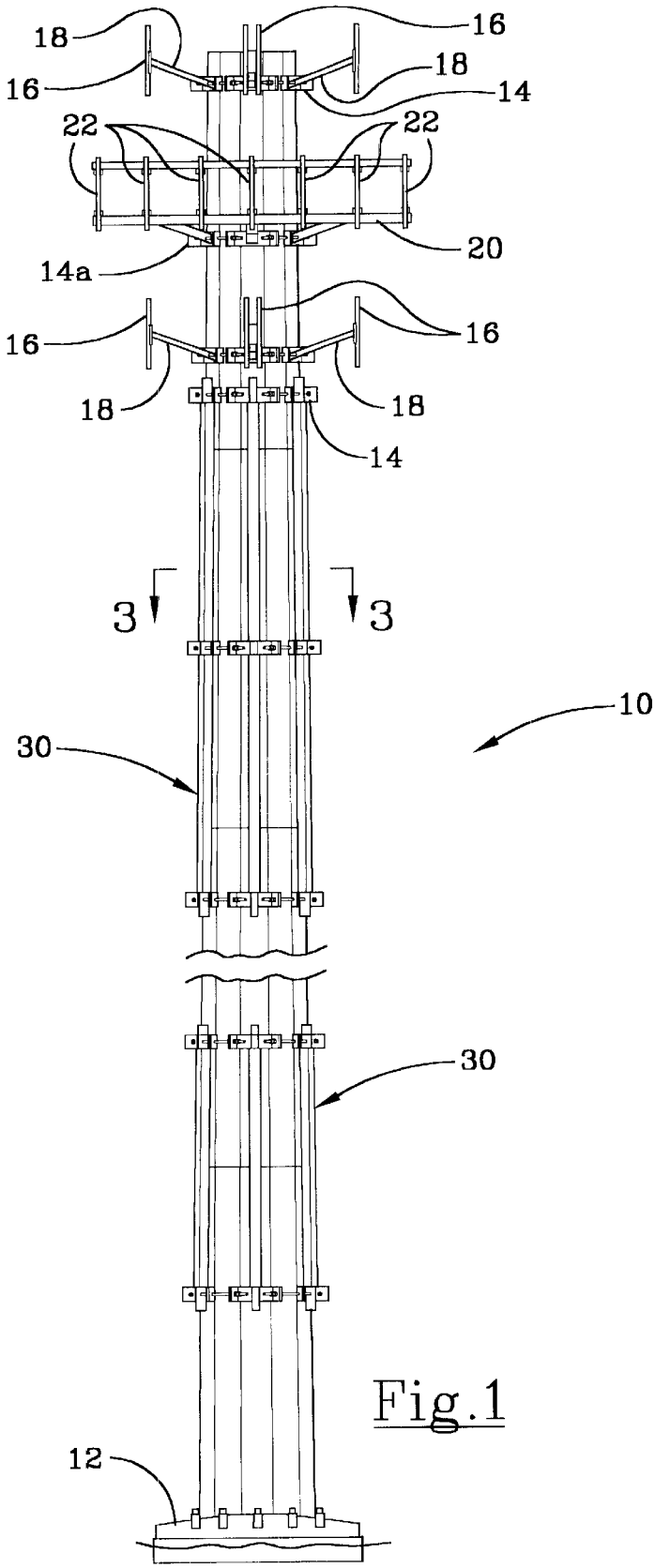
FIG. 1 is a segmented front view of the reinforcement apparatus of the present invention providing added stability and reinforcement to a monopole tower.

The drawings of FIGS. 1–4 illustrate a reinforcing apparatus formed upon an already erected monopole wireless communications tower to add strength and stability by incorporated perimeter rods being connected to one another through adjustable interconnection brackets. FIG. 1 depicts a multi-sided monopole tower 10 having an equal number of facets or sides and a base 12, which is partly buried underground to provide sufficient stability so as to retain the monopole tower 10 upright to withstand the maximum force moment and any conceivable environmental conditions. Located at the top of the monopole are one or more antenna mounting clamps 14 supporting a series of original antenna systems 16 necessary to receive and transmit on one or more wireless communications networks on a corresponding number of support arms 18. Also shown in FIG. 1 is an add-on antenna platform 20 which is positioned between the two original antenna systems 16 being held in position by mounting clamps 14*a* and support arms 18*a*. Attached to the antenna platform 20 are a series of antennae 22 enhancing the number of communications channels for the wireless communications networks available from the monopole tower.

Typical monopole towers range from 50 to 250 feet in height. Due to the necessary positioning of the antennas at the top of the monopole towers, the combination of wind conditions against the increase in the wind deflection surface area of the add-on antenna platform 20 and antennae 22 and the additional weight of the add-on antenna systems, including required mounting clamps, subjects the monopole tower 10 to additional force moments, sometimes substantially beyond the original maximum forces to which the monopole tower 10 was constructed. Thus, a need to provide reinforcement to the monopole structure is needed to avoid the potential catastrophic failure of the tower 10. Hence, the requirement to apply a reinforcing apparatus along the exterior of the monopole tower 10 to negate the increase in the force moment and retain the structural integrity of the monopole tower 10.

Although not illustrated in the drawings, the base 12 of the monopole tower 10 can be modified to augment the ability to retain the tower structure in its vertical orientation by placing outrigger structures extending radially away from the monopole tower 10 and attached to either the bottom of the monopole, and/or to the portion of the base extending out of the ground, and/or to an extension of the base extending out of the ground, to provide additional reinforcement against the increase in the force moment.

Although wireless communications towers can range from 50–250 feet in height, the monopole tower 10 as illustrated in FIG. 1 can be described as being approximately 120 feet in height. Monopoles towers 10 of such height, typically need added reinforcement at differing heights from the base due to changes in weight loading and wind displacement factors brought about by one or more add-on antenna systems 20. Although, not shown to precise scale in the drawings, the reinforcement apparatus 30 located along the outer surface of the monopole tower 10 may be approximately 10 to 20 feet in length. When additional support is needed at a predetermined height from the base 12, an additional reinforcement apparatus 30 can be attached above or below another to increase the overall length of the reinforcement apparatus 30 as shown closer to the top of the monopole tower 10 in FIG. 1.

Figure 2:
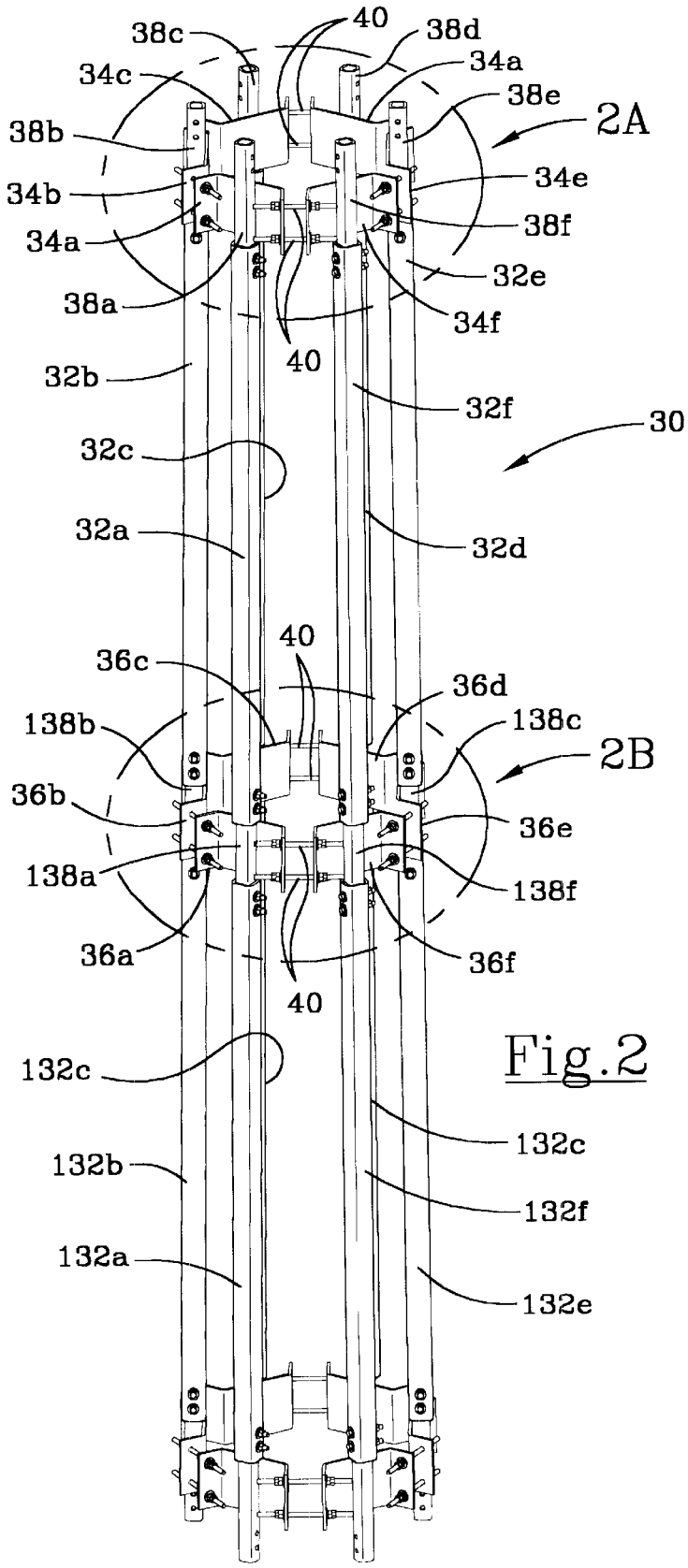
FIG. 2 is a perspective view of two joined segments of the reinforcement apparatus of the present invention.

Depicted in FIG. 2 is the reinforcement apparatus 30 which is constructed of a series of tubular support rods 32*a*–32*f* secured to and extending along the exterior surface of the monopole tower 10 which provide the needed reinforcement. The tubular to support rods 32*a*–32*f* are preferably made of steel having rust resistance properties, e.g. galvanizing, but any other suitable metal or material being of sufficient strength, resistant properties sufficient to withstand environmental conditions causing deterioration, and formable into a tubular or hollow elongated structure, is within the scope of the invention. The length of the reinforcing support rods 32 can vary within the range of 8 to 20 feet in length, with a preferable length being 10 to 12 feet.

The support rods 32*a*–32*f* extend along the exterior surface of the monopole tower 10 and are attached over and along the exterior surface by way of first and second sets of adjustable mounting clamps 34*a*–34*f* and 36*a*–36*f*, respectively. Both sets of adjustable mounting clamps 34, 36 circumscribe the exterior surface of the monopole tower 10 and attach by interconnecting to another within each set to form a secure mount. FIG. 2 illustrates the diversity of the adjustable mounting clamps 34, 36, in that the adjustable mounting clamps 34, 36 can be used to receive and hold the support rods 32 from either of the two outwardly extending ends of the guide tubes 38, as shown in FIG. 2A, or at both ends of the guide tubes 38, as illustrated in FIG. 2B.

Figure 2A:
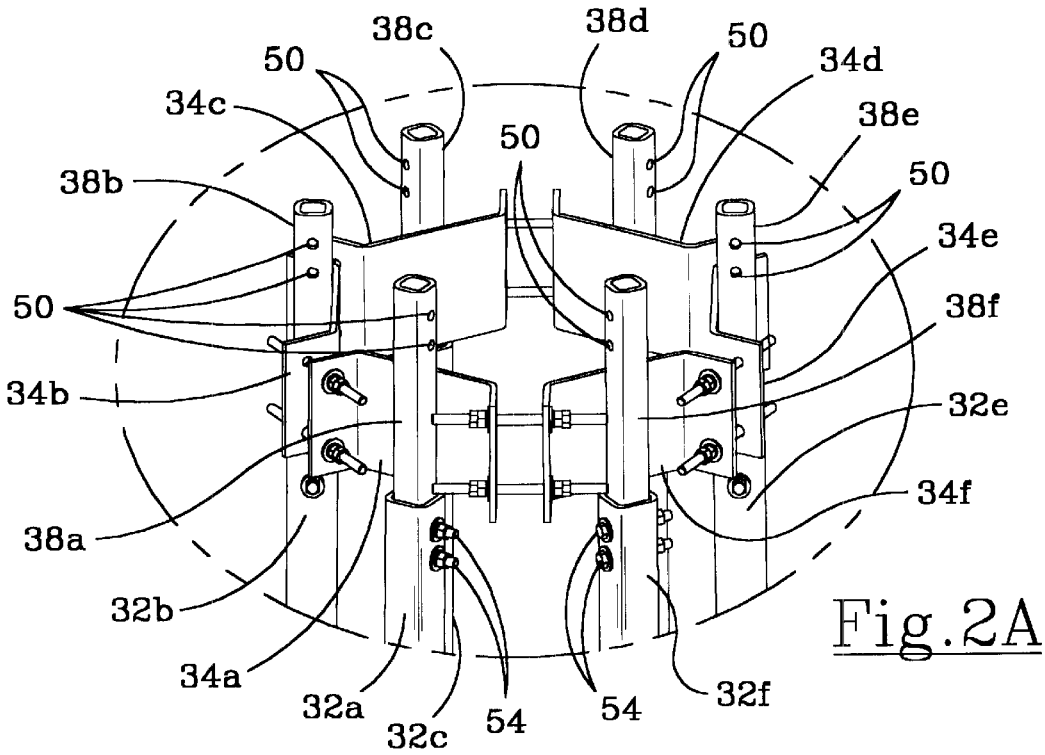
FIG. 2A is an enlarged view of the upper bracket arrangement of the reinforcement apparatus of FIG. 2.
Figure 2B:
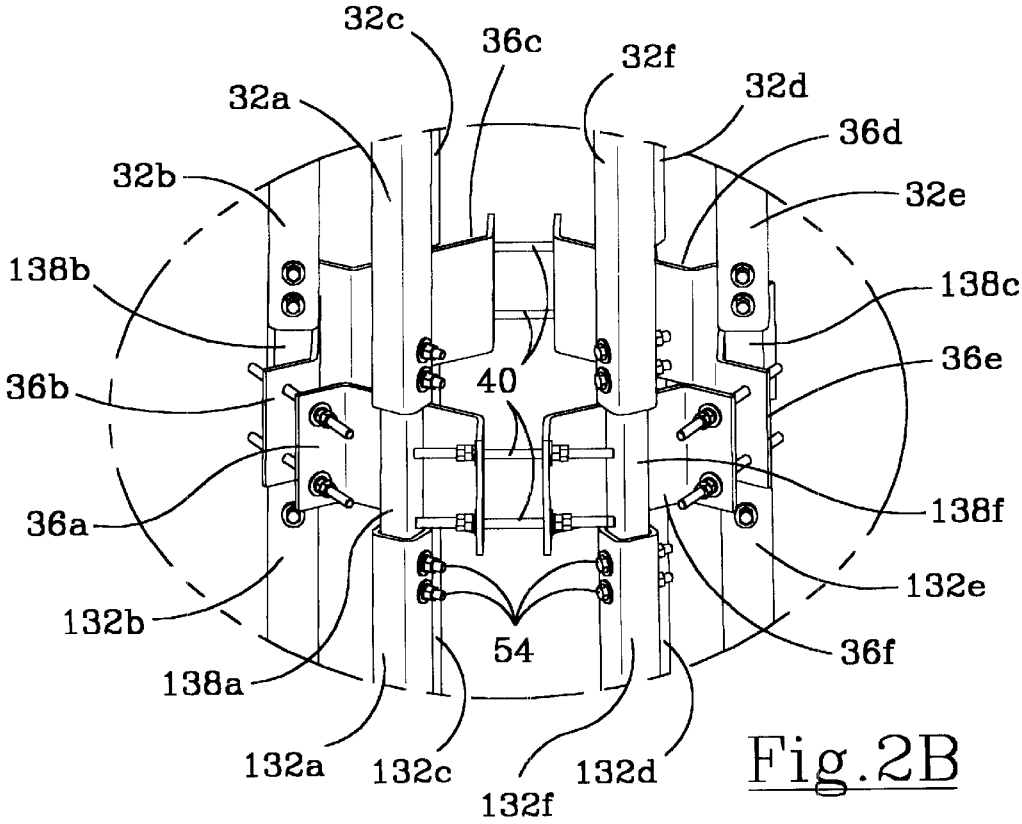
FIG. 2B is an enlarged view of the middle bracket arrangement of the reinforcement apparatus of FIG. 2.

In further detail, FIGS. 2A, 2B illustrate the series of first and second sets of adjustable mounting clamps 34, 36, and a plurality of interconnecting tightening means 40. Guide tubes 38*a*–38*f* extend outwardly in opposing vertical directions from each of the adjustable mounting clamps 34*a*–34*f*. The guide tubes 38 have an outside dimension or square width approximately equal to or slightly less than the inside dimension or square width of the perimeter support rods 32. Due to the relative insignificant size difference between the outside dimension of the guide tubes 38 and the inside dimension of the support rods 32, a snug and secure fit can be achieved when the guide tube 38 is inserted into a cooperating support rod 32.

The plurality of interconnecting adjustable mounting clamps 34, 36 are connected to one another by interconnecting tightening means or adjustable attachment members 40, which are preferably threaded rods having nuts and various washers to secure the ends of the threaded rods 40 to the respective clamps 34, 36. By utilizing threaded rods and nuts, the diameter of the adjustable mounting clamps 34, 36 can be easily and inexpensively increased or decreased to fit securely against a respective face or side at a predetermined height along the tapered monopole tower 10. The adjustability of the mounting clamps 34, 36 is a critical feature to the present invention, in that other mounting clamps having differing arc length diameters to match the circumferential arc length at the predetermined height along the monopole tower need to be custom made to fit snugly against the exterior surface at a number of different locations along the tapered monopole. To the contrary, the adjustable mounting clamps 34, 36 of the present invention are adjustable in their respective interconnection spacings to accommodate the different circumferential arc lengths of the monopole at a plurality of heights from the base 12 or ground level. They are not restricted to a limited number of locations along a tapered monopole tower which locations match the arc length of the contacting surface of the specialized mounting clamps to the circumferential arc length of the tower at the point of attachment. Rather, the adjustability of interconnecting spacings of the mounting clamps 34, 36 permits the reinforcement apparatus 30 the independence and capability to be positioned and tightly secured at virtually any location along the length (height) of the monopole tower 10 by varying the interconnection spacings, or the number of mounting clamps.

Figure 3:
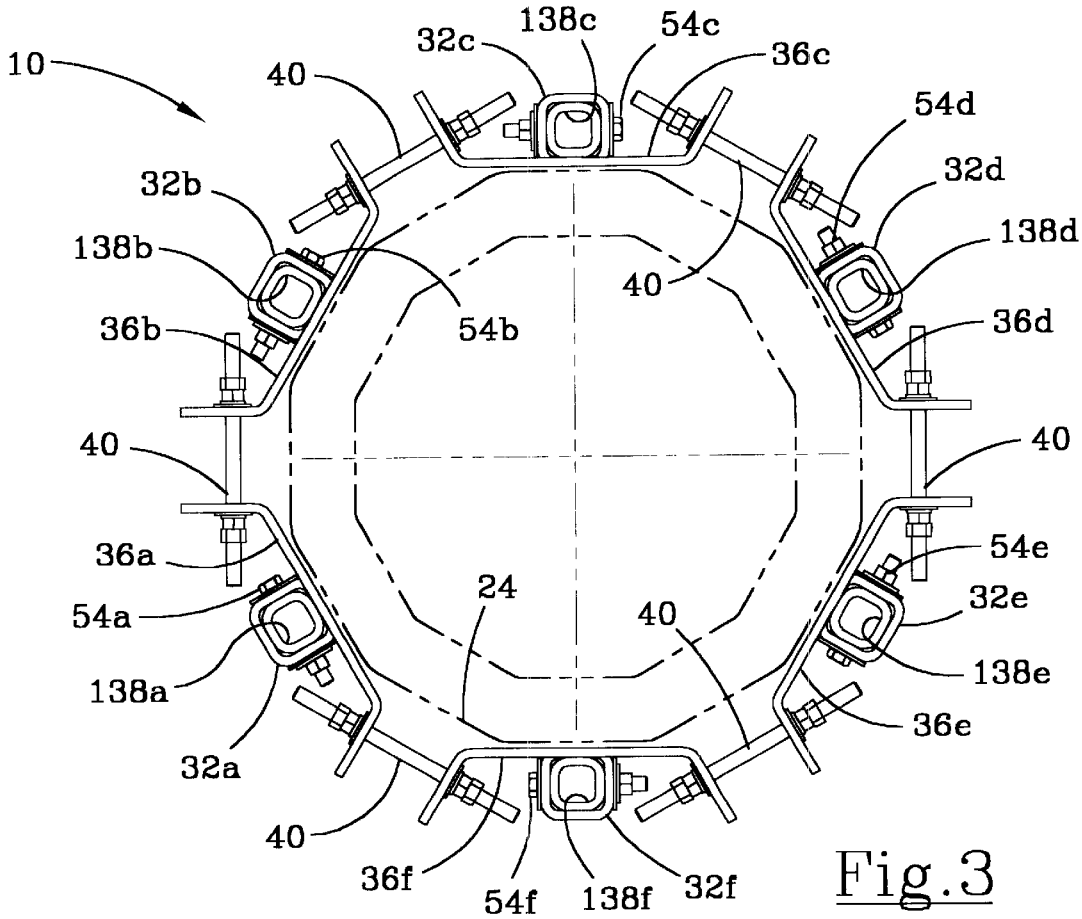
FIG. 3 a sectional view of the reinforcement apparatus of the present invention taken along Line 3—3 of FIG. 1.

FIG. 3 shows a cross-sectional view of the reinforcement apparatus 30 secured to and around the multi-sided monopole tower 10. Although the monopole tower 10 depicted in the drawings has a plurality of facets (faces or sides) 24 extending the height of the tower, other types of poles exist which may have a circular cross-sectional structure. The adjustable mounting clamps 34, 36 of the present invention is not limited to only poles having a number of sides 24, but can also easily and securely attach to circular (or round) poles as well. In FIG. 3 one can see the number of sides 24 of the monopole tower 10 as existing in an even number of plural sides. The number of sides can vary in order to reduce wind resistance the more sides the less wind resistance. In the case of the depicted monopole tower 10, the number of sides 24 is 12, which number can range from as few as three or five to as high as twenty, or more sides. One can also view the internal hollow 26 of the monopole tower 10 through which the wires and cables for the wireless communications networks are run.

Figure 4:
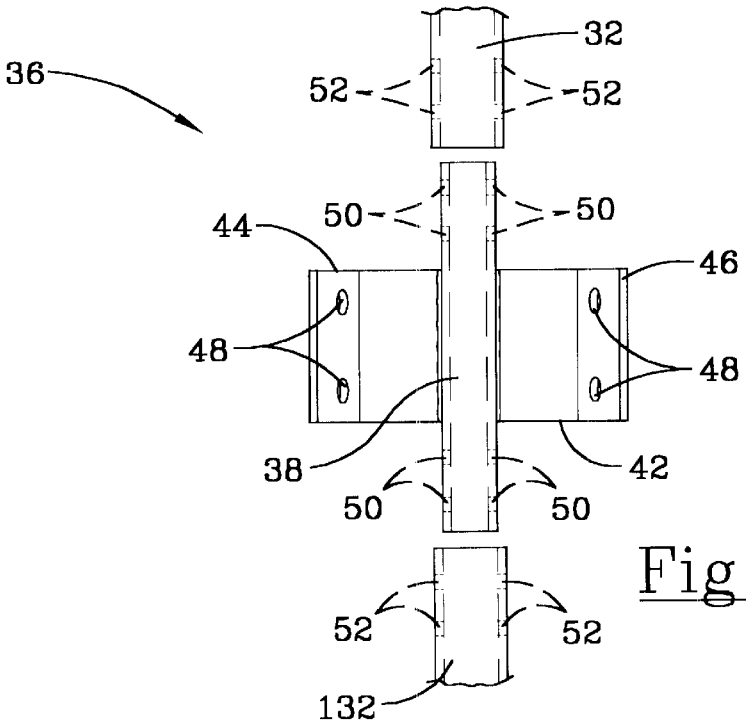
FIG. 4 is an exploded view of first and second support rods connecting to one of the adjustable mounting clamps of the present invention.

As shown in FIG. 4, the adjustable mounting clamp 34, 36 includes a metal bracket plate 42 having first and second ends 44, 46 extending away at angles from a flat central portion of the metal plate 42. Located on the first and second ends 44, 46 of each metal plate 42 are a series of openings 48 for receiving the interconnecting tightening means or threaded rods 40. Attached to the metal bracket plate 42 along the flat central portion of the plate 42 by welding (or any other practical method of metal to metal attachment) is the guide tube 38. Although the guide tubes 38 are preferably welded to the flat central portion of the metal bracket plate 42, as illustrated in FIG. 4, it is also possible to make the guide tube 38 and the bracket plate 42 integrally as a single unit. Regardless of how the interconnecting brackets 42 are manufactured or machined, the metal brackets 42 and guide tubes 38 are galvanized to prevent and prohibit any deterioration from future rust formation or otherwise.

The guide tube 38 is oriented transversely to the longer dimension of the bracket plate 42 so that the bracket plate 42 can connect horizontally around the monopole tower 10 and the guide tube 38 can connect to the vertically oriented reinforcement or support rods 32. The guide tube 38 should fit snugly within the interior dimension of the reinforcement rod 32 without excessive movement or play. The guide tube 38 should extend above and below the bracket plate 42 a distance sufficient so that the support rods 32 do not wobble, but are retained in substantially vertical alignment with the guide tubes 38. The preferable length of each of the guide tubes 38 is in the range of approximately 18 to 36 inches, since the height of the bracket plates is the range of 6 to 12 inches. Within these dimensional ranges the guide tubes 38 extend sufficiently into the ends of the support rods 32 to maintain the reinforcing rods 32 in vertical alignment, which is to an approximate depth within the rods 32 in the range of 6 to 12 inches.

Additionally, the interconnecting brackets 42 can be fabricated in different widths, varying in length over the range of 6 to 18 inches. Depending on the facets (faces or sides) 24 in the monopole tower 10, it is advantageous to utilize an adjustable reinforcing apparatus 30 having interconnecting brackets 42 of predetermined dimensions within the recited ranges to maximize the surface area of the bracket 42 in contact with the monopole 10. By matching the height and length dimensions of the interconnecting brackets 42 with the width of the side 24 of the monopole 10, optimal stability and secure attachment can be achieved.

Located on each end of both the guide tubes 38 and the reinforcing support rods 32 are openings 50, 52 for receiving attaching members 54 to secure the reinforcing support rods 32, 132 to the guide tubes 38, 138. Upon insertion of the guide tube 38, 138 into the respective ends of the reinforcing support rods 32, 132 the openings 50, 52 placed therein are aligned and receive the attaching members 54 which include threaded bolts, nuts and locking and spacing washers, or any other instrumentality which can be tightened to secure the reinforcing support rods 32 along the exterior of the tower 10. Although the attaching members 54 are preferably as described above for permitting an easily adjustable and mobile assembly of the reinforcement apparatus 30, the present invention is not limited to, such attaching members 54 and could conceivably utilize other means for attaching the guide tubes to the support rods.

There are a number of methods for constructing the reinforcement apparatus 30 of the present invention onto previously erected monopole towers 10. The preferred method for constructing the reinforcement apparatus 30 of the present invention includes the steps of determining one or more specific locations on the tower 10 in need of reinforcement subsequent to the mounting onto the tower 10 of additional antenna systems 20. Upon determining the location(s), a first set of adjustable mounting clamps 36 is tightly secured on and around the surface of the monopole tower 10 at the predetermined height from the base 12 utilizing the interconnecting tightening means 40. The support rods 32 are positioned onto the guide tubes 38 of the first set of adjustable mounting clamps 36, by placing the hollow ends of the reinforcing support rods 32 over the ends of the respective guide tubes 36 and securing the support rods 32 to the guide tubes 38 by use of the attaching members 54 inserted through the respective openings 50, 52. Upon positioning and securing the reinforcing support rods 32 in the first set of adjustable mounting clamps 36, a second set of adjustable mounting clamps 34 is secured on and around the surface of the monopole tower 10 at a distance above the first predetermined reinforcing location the approximate distance of the reinforcing support rods length dimension. The unattached ends of the reinforcing support rods 32 are then positioned onto the guide tubes 38 of the second set of adjustable mounting clamps 34 by placing the hollow ends of the reinforcing support rods 32 over the ends of the respective guide tubes 36 and securing the support rods 32 to the guide tubes 38 by use of the attaching members 54 inserted through the respective openings 50, 52. After adjusting for the proper vertical alignment and positioning of the reinforcing support rods 32, the reinforcement apparatus 30, i.e. each bracket plate 42, is tightly secured to the monopole tower 10 by tightening the interconnecting tightening means (or threaded rods) 40. In this manner the bracket plates 42 and the reinforcing support rods 32 are in proximate contact with the exterior surface of the monopole tower 10 so as to supply the added rigidity of structure to withstand the added force moment from the added weight and wind shear from the additional antenna system 20 surface area.

In addition to the advantages apparent from the foregoing description, the reenforcement apparatus 30 of the present invention uses tubular steel support rods secured to and around the exterior surface of a monopole tower by adjustable mounting clamps 42, thereby providing added stability and rigidity to the existing monopole tower 10. A further advantage of the present is the adjustability of the mounting clamps 34, 36 enabling the reinforcement apparatus 30 to be secured to tapered monopoles 10 regardless of diameter and the number of facets or sides 24.

Another advantage of the present invention is the convenience of constructing the reinforcement apparatus 30. Other prior art reinforcements require welding at extreme heights, a large number of personnel and elaborate structures which take months to fabricate and construct. The reinforcement apparatus 30 of the present invention can be constructed onto existing monopole towers 10 without the need for welding, using a small number of personnel, and can be constructed within a couple of days from an existing inventory of pre-fabricated parts.

A further advantage of the present invention is the low cost effectiveness. Due to the manufacturing of custom parts, the large number of personnel and equipment required, and length of time for fabrication and completion, prior reinforcement systems are extremely costly. The reinforcement apparatus 30 of the present invention does not require the manufacture of custom parts due to the infinite adjustability of the mounting clamps 42, does not require a large number of personnel or equipment, and therefore, is relatively inexpensive to construct.

The present invention may be embodied in other specific terms without departing from the spirit of essential attributes thereof and, accordingly, the described embodiments are to be considered in all respects as being illustrative and not restrictive, with the scope of the invention being indicated by the appended claims, rather than the foregoing detailed description, as indicating the scope of the invention as well as all modifications which may fall within a range of equivalency which are also intended to be embraced therein.

What is claimed is:

1. A method for reinforcing a tapered monopole structure carrying a number of communications antenna arrays comprising the steps of:

a) attaching and loosely securing a first set of at least two adjustable mounting clamps having guide tubes thereon at a predetermined reinforcement location along the monopole structure circumscribing the monopole structure and separated a distance apart from one another;

b) connecting a set of reinforcing support rods to the first set of at least two adjustable mounting clamps by inserting the guide tubes thereon into cooperating ends of the set of reinforcing support rods;

c) attaching and loosely securing a second set of at least two adjustable mounting clamps having guide tubes thereon at a location approximating the length of the reinforcing support rods above said predetermined reinforcement location along the monopole structure circumscribing the monopole structure and separated a distance apart from one another;

d) connecting said set of reinforcing support rods to the second set of at least two adjustable mounting clamps by inserting the guide tubes thereon into the other cooperating ends of the set of reinforcing support rods; and e) tightly securing the plurality of support rods to the adjustable mounting clamps by inserting affixing members therethrough and snugly tightening the two sets of adjustable mounting clamps to the monopole structure by tightening the length adjustable attachment members such that said reinforcing support rods are in proximate contact with the exterior surface of the monopole structure providing the needed additional reinforcement to offset any increase in the force moment of the monopole structure resisting the weight and wind resistance from one or more additional communications antenna arrays.

2. The method of claim 1 further comprising the steps of:

a) attaching and loosely securing a third set of at least two adjustable mounting clamps having guide tubes thereon at a location approximating the length of the reinforcing support rods above said predetermined reinforcement location along the monopole structure circumscribing the monopole structure and separated a distance apart from one another;

b) connecting another set of reinforcing support rods to the second set of at least two adjustable mounting clamps by inserting the guide tubes thereon into cooperating ends of the another set of reinforcing support rods;

c) connecting said another set of reinforcing support rods to the third set of at least two adjustable mounting clamps by inserting the guide tubes thereon into the other cooperating ends of the set of reinforcing support rods; and d) tightly securing the plurality of support rods to the adjustable mounting clamps by inserting affixing members therethrough and snugly tightening the two sets of adjustable mounting clamps to the monopole structure by tightening the length adjustable attachment members such that said reinforcing support rods are in proximate contact with the exterior surface of the monopole structure providing the needed additional reinforcement to offset any increase in the force moment of the monopole structure resisting the weight and wind resistance from one or more additional communications antenna arrays.

* * * * *